US008949045B2

(12) United States Patent
Skovmose Kallesøe

(10) Patent No.: US 8,949,045 B2
(45) Date of Patent: Feb. 3, 2015

(54) METHOD FOR DETERMINING CHARACTERISTIC VALUES, PARTICULARLY OF PARAMETERS, OF A CENTRIFUGAL PUMP AGGREGATE DRIVEN BY AN ELECTRIC MOTOR AND INTEGRATED IN A SYSTEM

(75) Inventor: Carsten Skovmose Kallesøe, Viborg (DK)

(73) Assignee: Grundfos Management a/s, Bjerringbro (DK)

( * ) Notice: Subject to any disclaimer, the term of this patent is extended or adjusted under 35 U.S.C. 154(b) by 384 days.

(21) Appl. No.: 13/375,530

(22) PCT Filed: May 26, 2010

(86) PCT No.: PCT/EP2010/003211

§ 371 (c)(1), (2), (4) Date: Dec. 1, 2011

(87) PCT Pub. No.: WO2010/139416

PCT Pub. Date: Dec. 9, 2010

(65) Prior Publication Data

US 2012/0136590 A1 May 31, 2012

(30) Foreign Application Priority Data

Jun. 2, 2009 (EP) ..... 09007299

(51) Int. Cl.
*G01F 1/34* (2006.01)
*F04D 15/00* (2006.01)

(52) U.S. Cl.
CPC ..... *F04D 15/0088* (2013.01)
USPC ..... 702/47; 702/182

(58) Field of Classification Search
USPC ..... 702/33, 44, 45, 47; 415/118; 73/168
See application file for complete search history.

(56) References Cited

U.S. PATENT DOCUMENTS 4,484,861 A * 11/1984 Sweeney et al. ..... 417/15
4,669,308 A 6/1987 Jorritsma
4,999,117 A 3/1991 Palmu et al.

(Continued)

FOREIGN PATENT DOCUMENTS

CN 1303467 A 7/2001
CN 1777738 A 5/2006
DE 39 18 294 A1 12/1989

(Continued)

OTHER PUBLICATIONS

Int'l Search Report issued on Oct. 29, 2010 in Int'l Application No. PCT/EP2010/003211.

(Continued)

*Primary Examiner* — Manuel L Barbee
(74) *Attorney, Agent, or Firm* — Panitch Schwarze Belisario & Nadel LLP

(57) ABSTRACT

A method for determining characteristic values of an electrometrically driven centrifugal pump assembly with a speed controller, said assembly being integrated in an installation, includes determining characteristic values by way of electrical variables of the motor and of the pressure produced by the pump, with which one successively runs to at least two different operating points of the pump. Delivery rates are determined in the installation at the run-to operating points, and the characteristic values are determined based on the delivery rates.

15 Claims, 6 Drawing Sheets

(56) References Cited

U.S. PATENT DOCUMENTS

| | | | | |
|---|---|---|---|---|
| 5,497,664 | A | 3/1996 | Jorritsma | |
| 6,648,606 | B2 * | 11/2003 | Sabini et al. | 417/53 |

FOREIGN PATENT DOCUMENTS

| | | | | |
|---|---|---|---|---|
| DE | 195 07 698 | A1 | 9/1996 | |
| EP | 1 072 795 | A1 | 1/2001 | |
| EP | 1072795 | A1 * | 1/2001 | F04B 51/00 |
| GB | 2 221 073 | A | 1/1990 | |
| JP | 59-178320 | A | 10/1984 | |
| JP | H04-49679 | U | 4/1992 | |
| JP | 2003-090288 | A | 3/2003 | |
| JP | 2005-351221 | A | 12/2005 | |
| JP | 2007-170309 | A | 7/2007 | |
| JP | 2008-063954 | A | 3/2008 | |
| JP | 2009-002162 | A | 1/2009 | |
| WO | 91/18266 | A1 | 11/1991 | |
| WO | 2004/059170 | A2 | 7/2004 | |

OTHER PUBLICATIONS

Office Action issued Feb. 25, 2014 in JP Application No. 2012-513492.

Office Action issued Jan. 26, 2014 in CN Application No. 201080024716.5.

* cited by examiner

METHOD FOR DETERMINING CHARACTERISTIC VALUES, PARTICULARLY OF PARAMETERS, OF A CENTRIFUGAL PUMP AGGREGATE DRIVEN BY AN ELECTRIC MOTOR AND INTEGRATED IN A SYSTEM

CROSS-REFERENCE TO RELATED APPLICATIONS

This application is a Section 371 of International Application No. PCT/EP2010/003211, filed May 26, 2010, which was published in the German language on Dec. 9, 2010, under International Publication No. WO 2010/139416 A1 and the disclosure of which is incorporated herein by reference.

BACKGROUND OF THE INVENTION

The application of centrifugal pumps is counted today as belonging to the state of the art in almost all technical fields. Typically, centrifugal pumps in the form of centrifugal pump assemblies are applied, consisting of the actual pump and an electrical drive motor mechanically connected thereto.

In order on the one hand to operate the centrifugal pump assembly in an energetic favourable manner, and on the other hand to adapt it as optimally as possible to the application purpose, today, even with small centrifugal pump assemblies of a small construction type, it is counted as belonging to the state of the art to equip these with a speed controller, typically with an electronic frequency converter. Such centrifugal pump assemblies with a speed controller are applied in installations, be it, for example, in heating installations, in sewage installations, in waste water installations, in installations for conveying ground water from a bore hole, to only name a few of typical applications.

It is particularly in installations, but not only there, that it is important, on the one hand to monitor the installation parts, and on the other hand to monitor the process variables. Thus, with centrifugal pump assemblies, it is known to provide a pressure sensor, typically a differential pressure sensor, which detects the pressure between the suction side and the pressure side produced by the pump, thus the delivery head, within the pump housing. Moreover, electrical variables of the motor, such as the power uptake of the motor, and the frequency at which the speed controller feeds the motor, are detected.

However, the detection of the previously mentioned values as a rule is not sufficient for determining the hydraulic operating point, since they permit no information on the delivery rate. The arrangement of flow monitors for detecting the through-flow within the pump is complicated and often prone to malfunction. A flow sensor, with which the flow speed and thus the delivery rate may be detected, is even more complicated and may not be practically applied in waste water technology.

In GB 2 221 073 A, it is counted as belonging to the state of the art, to indirectly compute the delivery rate of the pump, by way of typically determining the filling level of a shaft, in particular the temporal change of the filling level, via a pressure measurement within the shaft. For this, firstly, given a switched-off pump, the average resulting feed quantity per unit of time is determined, and then with the pump switched on, one determines by how much the filling level reduces per unit of time, in order then to conclude the delivery rate under the assumption that the same feed is effected in the time in which the pump runs, as in the time in the pump does not run. This method is complicated since not only is a time measurement additionally required, but also one must also detect the change of the filling level when the pump does not run. Moreover, the accuracy of the detected pump delivery rates depends on the continuity of the feed.

BRIEF SUMMARY OF THE INVENTION

Against the above background, it is a objective of a preferred embodiment of the present invention to provide a method with which the mentioned disadvantages may be avoided where possible and which permits the detection also of the hydraulic variables of the pump on operation, with simple technical means.

According to a preferred embodiment of the present invention, the objective is achieved by way of electrical variables of a motor and/or a speed controller and of a pressure produced by a pump, with which one successively runs to at least two different operating points of the pump, wherein delivery rates are determined on an installation-side at run-to operating points, and the characteristic values are thus determined. Advantageous designs of the invention are to be deduced from the subsequent description and the drawing. The features of the dependent claims, as well as those of the subsequent description, may also be applied on their own, as well in a combination other than the described one, inasmuch as this appears to be useful.

The method according to a preferred embodiment of the present invention serves for determining characteristic values, in particular of parameters of an electrometrically driven centrifugal pump assembly with a speed controller, said assembly being integrated into an installation. These characteristic values are determined on the one hand by way of electrical variables of the motor and/or the speed controller, as well as on the other hand by way of the pressure produced by the pump. For this, one successively runs to at least two different operating points of the pump, wherein the delivery rates are determined in the installation at the run-to operating points, and the characteristic values are thus determined.

After determining the characteristic values, in particular the parameters, one may then further only detect and control the hydraulic operating values of the pump as well as further functions whilst utilising the electrical variables of the motor or the speed controller and the pressure produced by the pump. Thereby, according to a preferred embodiment of the present invention, one envisages at least two operating points being run to, in order to determine the characteristic values at least with an accuracy which permits meaningful conclusions in later operation. It is to be understood that the characteristic values may not necessarily be determined in an unambiguous manner on running to only two operating points. For this reason, preferably according to a preferred embodiment of the present invention, at least three, four or nine, thirteen or even more operating points are run to, in order to detect an adequate number of characteristic values with a sufficient accuracy, in order then later to largely make do without the detection of delivery rates also on the installation side. It is to be understood that with an increasing number of operating points, not only does the accuracy of the determined characteristic values, in particular of the parameters increase, but also the accuracy of the deliver rates to be determined on the installation side.

An electrometrically driven centrifugal pump assembly in the context of a preferred embodiment of the present invention is to be understood as an electric motor with a centrifugal pump which is driven by this and which typically has a common shaft. A speed controller, typically a frequency converter, which may change the electrical energy supplied to the motor, at least with regard to the frequency, typically however also with regard to the voltage, within a large range, is assigned to the assembly. The electrical variables of the motor which thereby are to be detected amongst other things, specifically the power uptake and the frequency, as the case may be, may be replaced by the corresponding variables of the speed controller. These variables are usually available on the part of the speed controller and thus do not need to be detected by separate measurement sensors. The pressure produced by the pump may be measured by a differential pressure sensor on the pump or also by way of suitable other pressure sensors at a different location, for example, at a distance to the pressure exit of the pump.

Installation in the context of a preferred embodiment of the present invention is each incorporation of a centrifugal pump assembly, for example a waste water installation, an installation with which the centrifugal pump assembly as a submersible pump delivers from a bore hole, an installation with which a centrifugal pump assembly delivers into a compensation tank, waste water installations with several centrifugal pump assemblies, and likewise.

According to an advantageous further formation of the method according to a preferred embodiment of the present invention, with regard to the characteristic values to be determined, it is the case of parameters which are part of a function which follows from the model laws of motor and/or pump, or also of functions which are preferably formed with a parameter-linear form. The latter permits specific values to be determined in a simple manner by way of specific operating points, without further differential observation. Since this function or functions follow the model laws of the motor and/or of the pump, a result which may be applied in practise results when running to only a few operating points.

Thereby, advantageously a function determining the delivery rate is used, which has at least one term with a hydraulic and/or electrical power-dependent variable, and a second term with a hydraulic and/or electrical power-dependent variable, which in each case are linked to one of the parameters in a multiplicative manner. Such a function is particularly favourable as a function of the delivery rate, since the delivery rate is determined in the run-to operating points on the part of the installation, and thus may be used directly for determining the characteristic values. A function determining the delivery rate, of the above mentioned type, is applied in a particularly advantageous manner, if the delivery rate may not be detected in an exact manner but for example only averaged over time, for example in waste water installations. Then, specifically, this comparatively unsafe value is on one side of the equation. Then, as the case may be, by way of running several times also to the same operating point, the parameters may be determined with a comparatively high accuracy since the accuracy of the applied delivery rate increases with an increasing number of run-to operating points and detected values. This applies in particular on the basis of the parameter-linear equations yet described in the following.

According to a further formation of a preferred embodiment of the present invention, particularly preferably one uses a function, with which the parameters form part of at least one part of a pump model and are linked as follows:

$$q = \gamma_1 \frac{p}{\omega_r} + \gamma_2 \frac{T}{\omega_r} + \gamma_3 \omega_r \qquad \text{Equation (a)}$$

In this equation, q is the delivery rate of the pump, p the delivery pressure of the pump, thus for example the differential pressure between the suction side and the pressure side, $\omega_r$ the rotational speed of the pump, T the drive torque of the pump and $\gamma_1$ to $\gamma_3$ the parameters of the part pump model, which are to be determined. For determining these parameters $\gamma_1$ to $\gamma_3$, at least two operating points are run to, in order or determine these at least approximately. It is to be understood that an unambiguous solution is not yet given, but due to the fact that the equation (a) represents a part of a pump model, it may already provide adequate information for some applications.

Alternatively to the previously mentioned pump module according to equation (a), the part pump module may be used according to equation (b) which is:

$$q = \gamma_0 \frac{1}{\omega_r} + \gamma_1 \frac{p}{\omega_r} + \gamma_2 \frac{T}{\omega_r} + \gamma_3 \omega_r \qquad \text{Equation (b)}$$

which is extended by the term $$\gamma_0 \frac{1}{\omega_r}$$

compared to the previously described pump model. This term is determined for compensating an affinity error, which may arise when the pressure p is determined as a distance to the pump, thus measured deviating from the pressure actually produced by the pump.

Alternatively or additionally, according to an advantageous further formation of a preferred embodiment of the present invention, one applies a part pump module, with which the parameters are linked as follows:

$$p^2 = \theta_0 + \theta_1 p + \theta_2 T + \theta_3 pT + \theta_4 T^2 + \theta_5 \omega_r^2 + \theta_6 p\omega_r^2 + \theta_7 T\omega_r^2 + \theta_8 \omega_r^4 \qquad \text{Equation (c)}$$

wherein p represents the delivery pressure of the pump, $\omega_r$ the rotation speed of the pump, T the drive torque of the pump and $\theta_0$ to $\theta_8$ the parameters of the part pump model to be determined. The equations (a), (b) and (c) in each case represent parts of a pump model, thus together ((a) and (c), or (b) and (c)) form a complete pump model, which is why it is particularly advantageous to determine the parameters of both equations, since then one may imitate a complete hydraulic power curve of the pump with a great accuracy. It is to be understood that a suitable multitude of different operating points is to be run to, in order to be able to determine the multitude of the parameters to be determined.

One advantageous further formation, in particular simplification of the method according to a preferred embodiment of the present invention, results by way of making do without determining the rotational speed of the pump $\omega_r$, and simply equating this with the frequency $\omega_e$ of the voltage supply of the motor.

$$\omega_r = \omega_e \qquad \text{Equation (d)}$$

This frequency value $\omega_e$ is available in the speed controller and therefore does not need to be determined. The same applies for determining the drive torque T of the pump. This may be simply determined by way of forming this from the quotient of the electrical power $P_e$ taken up by the motor, and the frequency $\omega_e$ of the voltage supply of the motor or the rotational speed of the pump $\omega_r$.

$$T = \frac{P_e}{\omega_e} \quad \text{Equation (e)}$$

The electrical power $P_e$ taken up by the motor is also available on the part of the speed controller, since the voltage and current are continuously detected there.

The method according to a preferred embodiment of the present invention for determining the characteristic values in the run-to operating points at least approximately requires the resulting delivery rate q of the pump. According to a preferred embodiment of the present invention, with the application of the pump assembly in a pressure compensated receptacle, typically in a well shaft or likewise, this may be determined at least approximately by way of detecting the temporal change of the fluid level in the shaft from which the pump delivers, and specifically on the one hand with the pump switched off, in order to detect the feed, and on the other hand with the pump switched on, at the respective operating point. Further required is the knowledge of the shaft geometry, for example, in particular the size of the shaft cross section, as the case may be in dependence on the filling height, if the shaft is designed for example in a conically tapering manner, in order to be able to assign the fluid quantity corresponding to the height difference of the fluid level. The detection of the fluid level may be effected in a simple manner by way of a pressure measurement, thus for example by way of a pressure sensor in the pump, which detects the static pressure when the pump is switched off. Alternatively, the filling level may also be detected in a mechanical manner or the delivery rate of the pump may be detected in a direct manner, if this is advantageous.

If the installation is formed by a bore hole with a bore hole pump located therein, according to a further formation of a preferred embodiment of the present invention, the delivery rate at the respective run-to operating point may be determined by way of the temporal change of the fluid level in the bore hole. Thereby, the fluid level change which results on the one hand with the pump switched off, and on the other hand with the pump switched on at one operating point, over a predefined period of time, are to be compared, in order to determine the delivery rate of the pump. Since the feed is not typically effected in a linear manner with such bore holes, it is advantageous to determine the feed quantity to the bore hole whilst using the following equations:

$$\frac{\Delta z_m}{\Delta t} = \eta_0 + \eta_1 z_m + \eta_2 z_m^2 + \ldots + \eta_k z_m^k \quad \text{Equation (f)}$$

$$q_{in} = A_w(\eta_0 + \eta_1 z_m + \eta_2 z_m^2 + \ldots + \eta_k z_m^k) \quad \text{Equation (g)}$$

in which

Zm is the fluid level in the bore hole,

Δt a time interval, $\Delta z_m$ the fluid level change during a time interval Δt, $q_{in}$ the computed feed into the bore hole, and $A_w$ is the cross section of the bore hole, and $\eta_0, \ldots, \eta_k$ are the parameters of a mathematic model imitating the feed into the bore hole.

Since these equations are likewise present in parameter-linear form, the parameters may be determined with common methods, as has been known for some time now with the computation of the feed for bore holes per se.

The method according to a preferred embodiment of the present invention is advantageously expanded further for applications with which the pump assembly delivers into an expansion container, by way of the delivery quantities in the run-to operating points being determined by way of the temporal change of the pressure in the expansion container of the installation, into which the pump delivers, and specifically whilst taking into account the temporal change of the container pressure, once with the pump switched on, and the other time with the pump switched off, in each case over a defined period of time.

Thereby, according to an advantageous further formation of the preferred method, the delivery rate of the pump is determined using the following equation:

$$q_{out} - q_{pump} = -\frac{K_e}{p_{out}^2}\frac{dp_{out}}{dt} \approx -\frac{K_e}{p_{out}^2}\frac{\Delta p_{out}}{\Delta t}, \quad \text{Equation (h)}$$

in which $q_{out}$ is the delivery flow exiting from the installation, $q_{pump}$ the delivery rate of the pump, $p_{out}$ the pressure in the expansion container, Δt a time interval, $\Delta p_{out}$ the pressure change in the expansion container during the time interval Δt, and $K_e$ a constant of the expansion container.

Thereby, the differential quotient $$\frac{dp_{out}}{dt}$$

has been replaced in a simplifying manner by the difference quotient $$\frac{\Delta p_{out}}{\Delta t},$$

which however as a rule is of no problem on running to an adequate quantity of operating points.

Advantageously, in later operation of the pump, one may determine the delivery rate with the method according to the invention, in particular on the basis of a part pump module, as it is specified in claim 4 and claim 5 according to the equations (a) or (b), without applying a flow monitor or a sensor for this. Thus, advantageously, one may determine the delivery rate solely on account of the electrical characteristic variables such as e.g. power uptake and frequency of the motor, as well as a pressure measurement. Thereby, as the case may be, further installation variables may be determined, for example the fluid quantity into the well or flowing to the system.

According to a further formation of the method according to a preferred embodiment of the present invention, this may also be used for monitoring the function of the pump assembly, by way of determining the characteristic values, in particular the parameters afresh at a temporal interval, and comparing them with previously determined ones. If these values agree to within a predefined tolerance amount, then it is to be assumed that the function of the pump assembly is unchanged. However, should these clearly or significantly differ from the previously determined ones, then a functional compromise of the pump is to be ascertained, for example due to a leakage of a seal, by way of increased friction with a defect of a bearing, or likewise.

If, as is envisaged according to a further formation of the method according to a preferred embodiment of the present invention, not only are the characteristic values, in particular parameters of a part pump model but those of a complete pump model are to determined at a temporal interval and compared, typically of such as is specified in certain dependent claims, then it is even possible to monitor the efficiency of the pump assembly, thus its effectiveness. Thereby, by way of the pump model, for example, the curve of the efficiency is imitated in dependence on the delivery of the pump, so that a power drop is visible also only in part regions, on comparison of the curves.

The method according to a preferred embodiment of the present invention is preferably carried out in an automatic manner with the help of a suitable control, which for example may be part of the digital control of a frequency converter, by way of automatically determining and processing the characteristic values. For this, the pump assembly is firstly operated in an identification mode, in that it automatically runs to several hydraulic operating points, in order to determine the characteristic values, in particular parameters, and is subsequently set into an operating mode, in which the previously determined characteristic values are applied for determining the operational variable of the installation, in particular the delivery rate of the pump assembly. If, for monitoring the pump assembly, the characteristic values need to be determined afresh after a certain time, the pump assembly is either set into the identification mode, and these values are determined afresh and then compared to the previously determined or initially determined ones.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
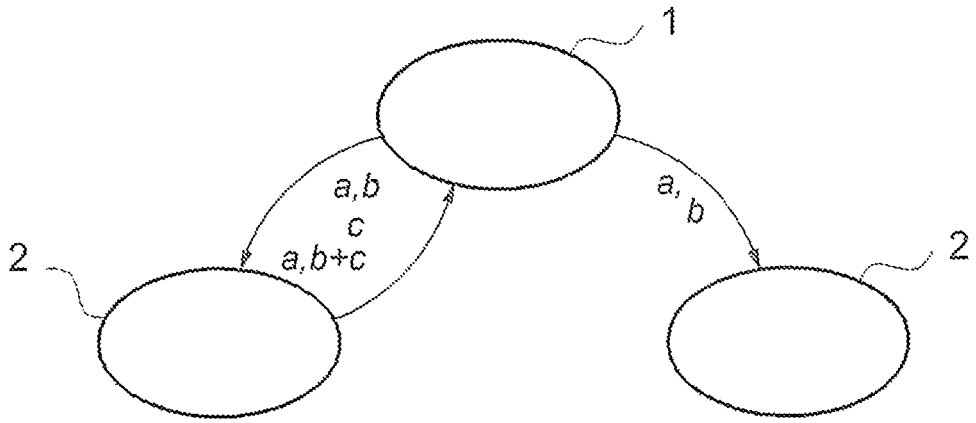
FIG. 1 is a diagram relating to the possible applications of a method according to a preferred embodiment of the present invention.

Certain terminology is used in the following description for convenience only and is not limiting. The words "left," "lower," "bottom" and "top" designate directions in the drawings to which reference is made. Unless specifically set forth herein, the terms "a," "an" and "the" are not limited to one element, but instead should be read as meaning "at least one." The terminology includes the words noted above, derivatives thereof and words of similar import.

Referring to the drawings in detail, wherein like numerals indicate like elements throughout the several views, as the diagram according to FIG. 1 illustrates, the pump assembly is identified in an identification mode 1, for example, the characteristic variables of the pump assembly are determined by way of running to at least two, preferably however a multitude of operating points, and determining the electrical power of the motor, the speed of the motor or more simply the frequency of the supply voltage of the motor, as well as the delivery pressure produced by the pump, at each of the operating points. The respective delivery rate thereby is determined on the part of the installation. When this identification mode 1 is completed, then after the parameters $\gamma_1$ to $\gamma_3$ of the equation (a) or the parameters $\gamma_0$ to $\gamma_3$ of the equation (b) are determined, one may then determine the delivery rate of the pump in the later operating mode 2 with the help of these equations (a) and (b).

If on the other hand the function or the power of the pump assembly is to be monitored, then a constant change between the identification mode 1 and the operating mode 2 is necessary, as is represented in the left part of the FIG. 1. In the identification mode 1, the parameters are likewise determined, and then the pump assembly runs in the operating mode 2, in order, after a predefined time (for example, one hour or a week) to return back again into the identification mode 1, where the parameters are determined once again. A comparison of the now determined parameters with the previously determined parameters permits an assessment in the simplest form of the function of the pump up to the detection of an efficiency change, as is represented by way of FIG. 7. The parameter detection of the equations (a) and (c) or (b) and (c) is necessary for the latter, whereas the parameter detection of the equations (a) or (b), or (c) is sufficient for the purely functional monitoring.

Figure 2:
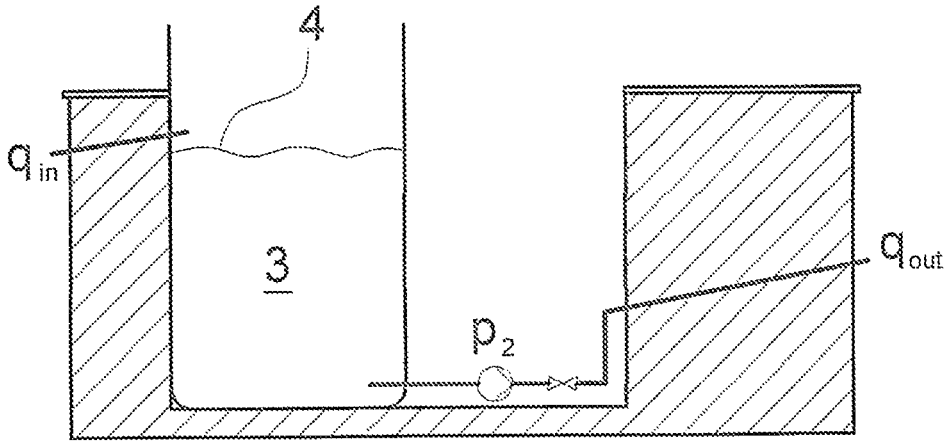
FIG. 2 is a greatly simplified schematic representation of an installation for application of a pump assembly in waste water technology according to a preferred embodiment of the present invention.

An installation is represented in FIG. 2, as is given for example for delivering waste water out of a shaft. The shaft 3 in FIG. 2, as is common with installations of this type, is designed in the manner of a vessel open to the top. The fluid level 4 with the feed of fluid $q_{in}$ moves to the top, and with the pump switched on moves to the bottom in accordance with the delivery rate $q_{pump}$. The pump delivers with the pressure p, which is the differential pressure between the suction side and pressure side. Thereby, the feed into the shaft 3 although not being constant, but averaged ($\overline{q}_{in}$) over a time interval $\Delta t$, is assumed to be quasi constant. Then, a feed quantity results from the change of the fluid level 4 and on the basis of the shaft cross section 3, and a discharge quantity $q_{out}$ with a sinking fluid level 4 when the pump pumps. Since fluid runs into the shaft 3 also during the time when the pump pumps, thus $q_{in}$ remains quasi constant, the delivery rate of the pump results from the discharge quantity $q_{out}$ and $q_{in}$.

Figure 3:
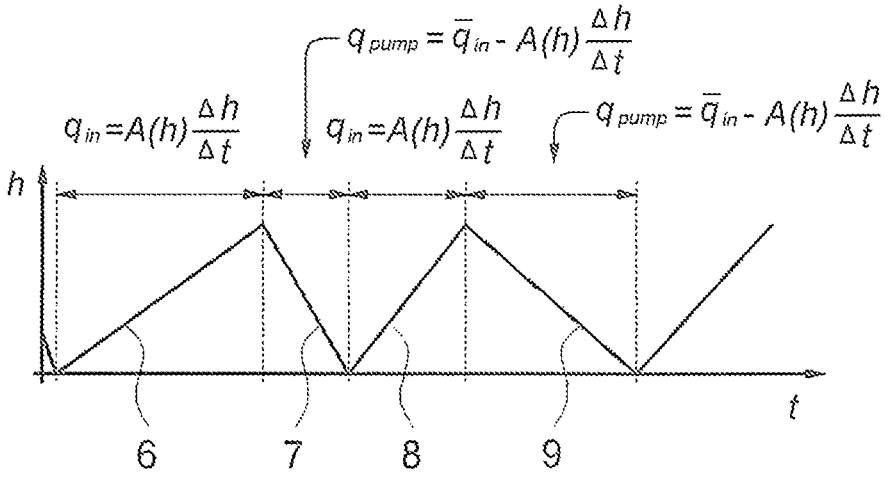
FIG. 3 shows a temporal fluid level change in the installation according to FIG. 2, and a delivery flow of the pump which may be derived therefrom.

FIG. 3 represents as to how this may be determined in detail. The diagram shows the filling level heights in the shaft 3 in dependence on the time t. In the first measurement interval 6 in FIG. 3, the changing filling level 6 over time $\Delta t$ is detected in the time in which the pump is switched off and is multiplied by the shaft cross section A (h). A feed quantity $q_{in}$ per unit of time flowing into the shaft 3 results from this. In the subsequent interval 7, the pump is switched on and runs to a first operating point, until the fluid level 4 again has the original level given at the beginning of the interval 6. Then the delivery rate $q_{pump}$ of the pump may be determined therefrom. This may be effected in an analog manner in a subsequent interval 8, 9, wherein this time, the feed quantity $q_{in}$ is larger and thus the pump requires longer in the interval 9, in order to obtain the original level again. Thus one runs to two operating points, with which, with the aid of equation (a) which represents a part pump model, one may determine the parameters of this equation at least to such an extent that the application of the method makes sense. Usefully, here however one would run to further operating points which does not necessarily need to be effected consecutively, but may also be effected at time intervals in the identification mode 1.

As FIG. 3 illustrates, with the methods applied there, the feed into the shaft is to be determined over the whole time, when the pump is switched off. As far as this is concerned, the method represented by way of FIG. 4 is more favourable, with which the intervals 10 and 11 are subdivided into part time sections Δt1 to Δt9, wherein the time sections Δt may be selected at random or by chance, so that a certain static distribution results.

Figure 5:
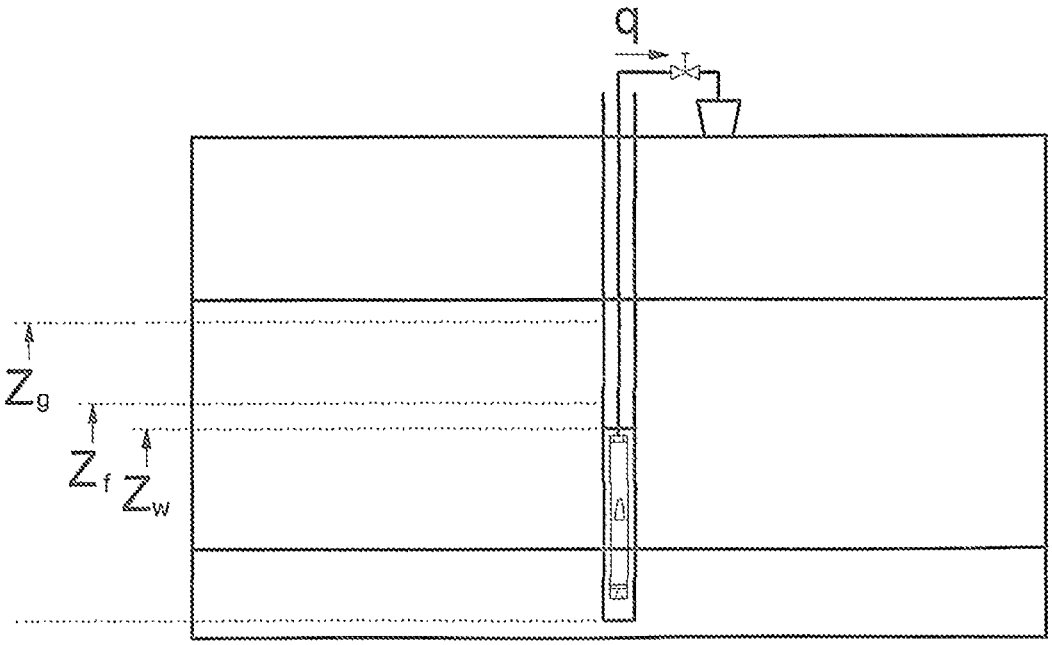
FIG. 5 is a schematic representation of an installation with a bore hole and pump assembly according to a preferred embodiment of the present invention.

An installation is represented by way of FIG. 5, with which the pump assembly is designed as a bore-hole pump 12 which is arranged in a bore hole 13. The bore hole pump 12 delivers the water collecting in the bore hole 13, to the surface. In FIG. 5, the current water level in the shaft 3, for example, the fluid level, is characterised with $Z_W$. $Z_g$ indicates the water table level, for example, the water level which would set in if one were not to pump away, and $Z_f$ represents the filter entry pressure, for example, the water level which is required to be surrounding, in order to penetrate the filter which is typically formed by sand around the well shaft. The principle for determining the delivery fluid of the pump previously described by way of the shaft 3 only conditionally leads to the result, for example, with great inaccuracy, since differently than with the shaft 3, the feed into the bore hole 13 is a function of the fluid level $Z_W$, for example, the higher the fluid level $Z_W$ in the bore hole, the lower is the feed. In order to take this into account, with this installation, the equations (f) and (g) are to be applied, in order to determine $q_{in}$, for example, the fluid feeding in per unit of time. These linear parameterised equations (f) and (g) may be solved in the usual manner by way of parameter identification, as is known per se with such installations and here is also not described in detail.

Figure 6:
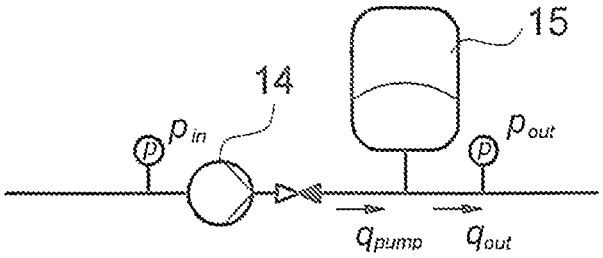
FIG. 6 is a schematic representation of an installation with which the pump assembly delivers into a compensation container according to a preferred embodiment of the present invention.

With the installation represented by way of FIG. 6, the pump 14 delivers into an expansion container 15, for example, into a closed container 15, which at least partly is filled with a compressible gas, which depending on the filling level is compressed to a greater or lesser extent, for example, that the pressure within the expansion container 15 is changeable. Since the delivery rate here, flowing out ($p_{out}$) as well as flowing in ($p_{in}$), is dependent on the pressure within the container 15, the equation (g) is to be used for determining the delivery rate of the pump, which takes into account the delivery rate in dependence on the pressure ($p_{out}$) in the expansion container and at the end of the discharge conduit, as well as the pressure change $\Delta p_{out}$ and a constant $K_e$ of the expansion container.

Figure 4:
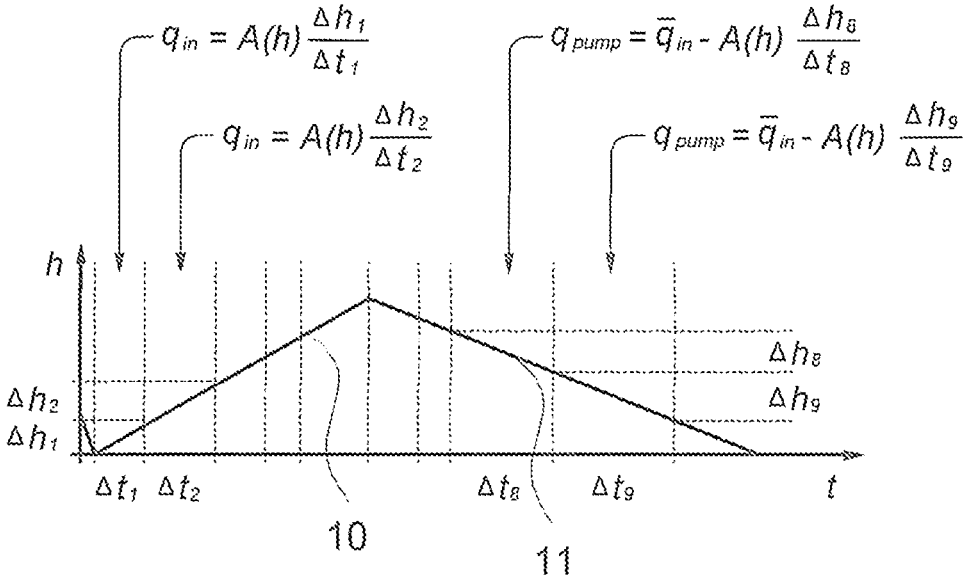
FIG. 4 is a diagram representation according to FIG. 3, a detection of the delivery flow of the pump on the basis of time intervals, which are smaller than the respective delivery interval.

It is to be understood that with all measurements, as have been represented by way of example and by way of FIGS. 3 and 4, these are to be repeated in a suitable manner, in order to detect different operating points and thus to determine the parameters of the part pump models formed by the equations (a) and (b) as well as (c). The more operating points one moves to, the more accurate is the later evaluation of the delivery rate of the pump on operation, thus in the operating mode. This, however, is more essential for monitoring the pump function, in particular the efficiency of the pump.

Figure 7:
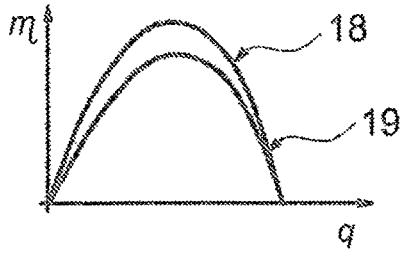
FIG. 7 shows a curve which represents the efficiency in dependence on the delivery rate.

FIG. 7 by way of example shows two curves which are formed by way of part pump models (b) and (c) and which represent the efficiency of the pump η over the delivery rate. The curve 18 has been acquired at the beginning of operation, whereas the curve 19 has been acquired after a considerable operating time, thus after having switched into the operating mode one or several times, for example, after five months. As the curves illustrate, the efficiency of the pump assembly has reduced almost over the complete delivery range of the pump. This e.g. may indicate a leakage within the pump, with which a part delivery flow is short circuited.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A method for determining characteristic values of an electromotorically driven centrifugal pump assembly with a speed controller, the assembly being integrated in an installation, the method comprising:

successively running at least two different operating points of a pump; and determining characteristic values by way of electrical variables of a motor or a speed controller, and of a pressure produced by the pump, wherein delivery rates are determined on an installation-side at run-to operating points, the characteristic values being determined based on the delivery rates; wherein a function determining the delivery rate comprises at least one term with a hydraulic or electrical power-dependent variable, and a second term with a hydraulic or electrical power-dependent variable, which in each case are linked to a parameter in a multiplicative manner.

2. The method according to claim 1, wherein parameters are part of a function following model laws of the motor or pump.

3. The method according to claim 1, wherein parameters form at least one part of a pump model and are linked as follows:

$$q = \gamma_1 \frac{p}{\omega_r} + \gamma_2 \frac{T}{\omega_r} + \gamma_3 \omega_r, \qquad \text{Equation (a)}$$

wherein:

q is the delivery rate of the pump, p the delivery pressure of the pump, $\omega_r$ the rotational speed of the pump, T the drive torque of the pump, and $\gamma_1$ to $\gamma_3$ the parameters of the part pump model.

4. The method according to claim 3, wherein the part of the pump model is used for determining the delivery rate of the pump during the operation.

5. The method according to claim 3, wherein a hydraulic power of the pump is determined with the pump model and wherein the hydraulic power is determined afresh at a temporal interval and is compared to a previously determined hydraulic power for monitoring a power performance of the pump.

6. The method according to claim 1, wherein parameters form at least one part of a pump model and are linked as follows:

$$q = \gamma_0 \frac{1}{\omega_r} + \gamma_1 \frac{p}{\omega_r} + \gamma_2 \frac{T}{\omega_r} + \gamma_3 \omega_r, \quad \text{Equation (b)}$$

wherein:

q is the delivery rate of the pump, p the delivery pressure of the pump, $\omega_r$ the rotational speed of the pump, T the drive torque of the pump, and $\gamma_0$ to $\gamma_3$ the parameters of the part pump model.

7. The method according to claim 1, wherein parameters form at least one part of a pump model and are linked as follows:

$$p^2=\theta_0+\theta_1 p+\theta_2 T+\theta_3 pT+\theta_4 T^2+\theta_5\omega_r^2+\theta_6 p\omega_r^2+\theta_7 T\omega_r^2+\theta_8\omega_r^4 \quad \text{Equation (c)},$$

wherein p is the delivery pressure of the pump, $\omega_r$ the rotation speed of the pump, T the drive torque of the pump, and $\theta_0$ to $\theta_8$ the parameters of the part pump model.

8. The method according to claim 7, wherein:

$$\omega_r=\omega_e \quad \text{Equation (d)}$$

and $$T = \frac{P_e}{\omega_e} \quad \text{Equation (e)}$$

are substituted, wherein $\omega_e$ is a frequency of a voltage supply of the motor and $P_e$ is electrical power taken up by the motor.

9. The method according to claim 1, wherein the delivery rates in the run-to operating points are evaluated by way of a temporal change of a fluid level in at least one bore hole, which forms part of an installation and from which the pump delivers, by way of comparison of the fluid level change and a feed quantity or discharge quantity resulting therefrom, with the pump switched off and with the pump switched on.

10. The method according to claim 9, wherein the feed quantity to the bore hole is determined whilst using the following equations:

$$\frac{\Delta z_m}{\Delta t} = \eta_0 + \eta_1 z_m + \eta_2 z_m^2 + \ldots + \eta_k z_m^k \quad \text{Equation (f)}$$

$$q_{in} = A_w(\eta_0 + \eta_1 z_m + \eta_2 z_m^2 + \ldots + \eta_k z_m^k), \quad \text{Equation (g)}$$

in which:

$Z_m$ is the fluid level in the bore hole,

Δta time interval, $\Delta z_m$ the fluid level change during a time interval Δt, $q_{in}$ the computed feed into the bore hole, $A_w$ the cross section of the bore hole, and $\eta_0, \ldots, \eta_k$ the parameters of a mathematic model imitating the feed into the bore hole.

11. The method according to claim 1, wherein the delivery rates in the run-to operating points are determined by way of a temporal change of a fluid level in a shaft of an installation, out of which the pump delivers, and while taking into account the temporal change of the fluid level, with the pump switched off and with the pump switched on, as well as the shaft geometry.

12. The method according to claim 1, wherein the delivery rates in the in the run-to operating points are determined by way of a temporal change of a pressure in an expansion container of an installation, into which container the pump delivers, and while taking into account the temporal change of the container pressure, with the pump switched off and with the pump switched on.

13. The method according to claim 12, wherein the delivery rate of the pump is determined while using the following equation:

$$q_{out} - q_{pump} = -\frac{K_e}{p_{out}^2}\frac{dp_{out}}{dt} \approx -\frac{K_e}{p_{out}^2}\frac{\Delta p_{out}}{\Delta t}, \quad \text{Equation (h)}$$

in which $q_{out}$ is the delivery flow exiting from the installation, $q_{pump}$ the delivery rate of the pump, $p_{out}$ the pressure in the expansion container, Δt a time interval, $\Delta p_{out}$ the pressure change in the expansion container during the time interval Δt, and $K_e$ a constant of the expansion container.

14. The method according to claim 1, wherein the characteristic values are determined afresh at a temporal interval and are compared to previously determined characteristic values for monitoring a function of a pump assembly.

15. The method according to claim 1, wherein the characteristic values are detected automatically in an identification mode, and subsequently, previously determined characteristic values are applied for determining operating variables of an installation in an operating mode.

* * * * *